United States Patent [19]

Hardin

[11] 4,095,863

[45] Jun. 20, 1978

[54] MANIFOLD MEANS AND SYSTEM FOR ELECTRICAL AND/OR PNEUMATIC CONTROL DEVICES AND METHOD

[75] Inventor: George T. Hardin, Knoxville, Tenn.

[73] Assignee: Robertshaw Controls Company, Richmond, Va.

[21] Appl. No.: 783,045

[22] Filed: Mar. 30, 1977

[51] Int. Cl.[2] ..... H01R 3/04

[52] U.S. Cl. ..... 339/15; 137/269; 137/884; 137/885

[58] Field of Search ..... 339/15; 137/269, 271, 137/833, 884, 885

[56] References Cited

U.S. PATENT DOCUMENTS

| | | | |
|---|---|---|---|
| 3,513,876 | 5/1970 | Tarbox | 137/269 X |
| 3,561,469 | 2/1971 | Kellstrom | 137/884 X |
| 3,572,368 | 3/1971 | Bullmer | 137/884 X |
| 3,707,989 | 1/1973 | Jullien-Davin | 137/885 X |

*Primary Examiner*—Roy Lake
*Assistant Examiner*—DeWalden W. Jones
*Attorney, Agent, or Firm*—Candor, Candor & Tassone

[57] ABSTRACT

A manifold adapted to detachably carry on one side thereof a plurality of pneumatically and electrically operated control units each of which is adapted to be fluidly and electrically interconnected to pneumatic structure and electrical structure of the manifold. That one side of the manifold has external interconnecting structure for the pneumatic structure and electrical structure whereby external pneumatic and electrical lines can be interconnected to the same side of the manifold that the units are adapted to be interconnected thereto. The manifold is formed from a pair of plates secured together in stacked relation with one of the plates defining at least that part of the one side of the manifold that carries the external interconnecting structure and is adapted to detachably carry the control units.

30 Claims, 7 Drawing Figures

MANIFOLD MEANS AND SYSTEM FOR ELECTRICAL AND/OR PNEUMATIC CONTROL DEVICES AND METHOD

This invention relates to an improved manifold system and manifold means therefor as well as to a method of making such manifold means.

It is well known that a manifold means has been provided for supplying the fluid and electrical current needed by a plurality of pneumatically and/or electrically operated control units that can be detachably secured to the manifold means. For example, see the U.S. Patent to Bullmer, U.S. Pat. No. 3,572,368 and the U.S. Patent to Tarbox, U.S. Pat. No. 3,513,876.

However, it was found according to the teachings of the invention in the co-pending patent application Ser. No. 780,038 filed Mar. 22, 1977 (Robertshaw Controls Company Docket No. 2816-CSD) that such prior known manifold means while permitting all of the desired number of pneumatically and electrically operated control units to be detachably secured to one side of the manifold means, complicated arrangements were provided for interconnecting the external pneumatic and electrical lines to the manifold means whereby installation and repair in the field of such manifold systems are relatively difficult and complicated. For example, in one prior known arrangement, the external electrical lines are attached to the other side of the manifold means opposite to the exposed side of the manifold means that receives the control units.

Thus, it was a feature of the aforementioned copending patent application to provide a manifold system wherein not only are the pneumatically and electrically operated control units readily detachably secured to one side of the manifold means thereof, but also the external pneumatic and electrical lines are interconnected to the same side of the manifold means that control units are interconnected thereto to facilitate the ease of installation and repair of such manifold system.

It is a feature of this invention to provide inprovements in the manifold system, manifold means and method of the aforementioned co-pending patent application.

In particular, one embodiment of this invention provides a manifold means adapted to detachably carry on one side thereof a plurality of pneumatically and electrically operated control units each of which is adapted to be fluidly and electrically interconnected to pneumatic means and electrical means of the manifold means. The one side of the manifold means has external interconnection means for the pneumatic means and the electrical means thereof whereby external pneumatic and electrical lines can be interconnected to the same side of the manifold means that the control units are adapted to be interconnected thereto. The manifold means comprises a pair of plates secured together in stacked relation with one of the plates defining at least that part of the one side of the manifold means that carries the external interconnection means and is adapted to detachably carry the control units.

Another embodiment of this invention provides a manifold means adapted to detachably carry on one side thereof a plurality of pneumatically and electrically operated control units each of which are adapted to be fluidly and electrically interconnected to pneumatic means and electrical means of the manifold means. The one side of the manifold means has external interconnection means for the pneumatic means and the electrical means thereof whereby external pneumatic and electrical lines can be interconnected to the same side of the manifold means that the control units are adapted to be interconnected thereto. The one side of the manifold means has plug-in recess means disposed therein substantially transverse to the major area of the one side and being adapted to receive plug-in nipples of the control units to detachably mount the control units to the one side of the manifold means.

In contrast, the manifold means of the aforementioned co-pending patent application was formed from a one-piece structure and required the nipple means of the control units to be plugged into recesses facing in the same direction as the major area of the one side of the manifold means.

Accordingly, it is an object of this invention to provide an improved manifold system having one or more of the novel features of this invention as set forth above or hereinafter shown or described.

Another object of this invention is to provide an improved manifold means for such a manifold system or the like, the manifold means of this invention having one or more of the novel features of this invention as set forth above or hereinafter shown or described.

Another object of this invention is to provide a method of making such a manifold means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
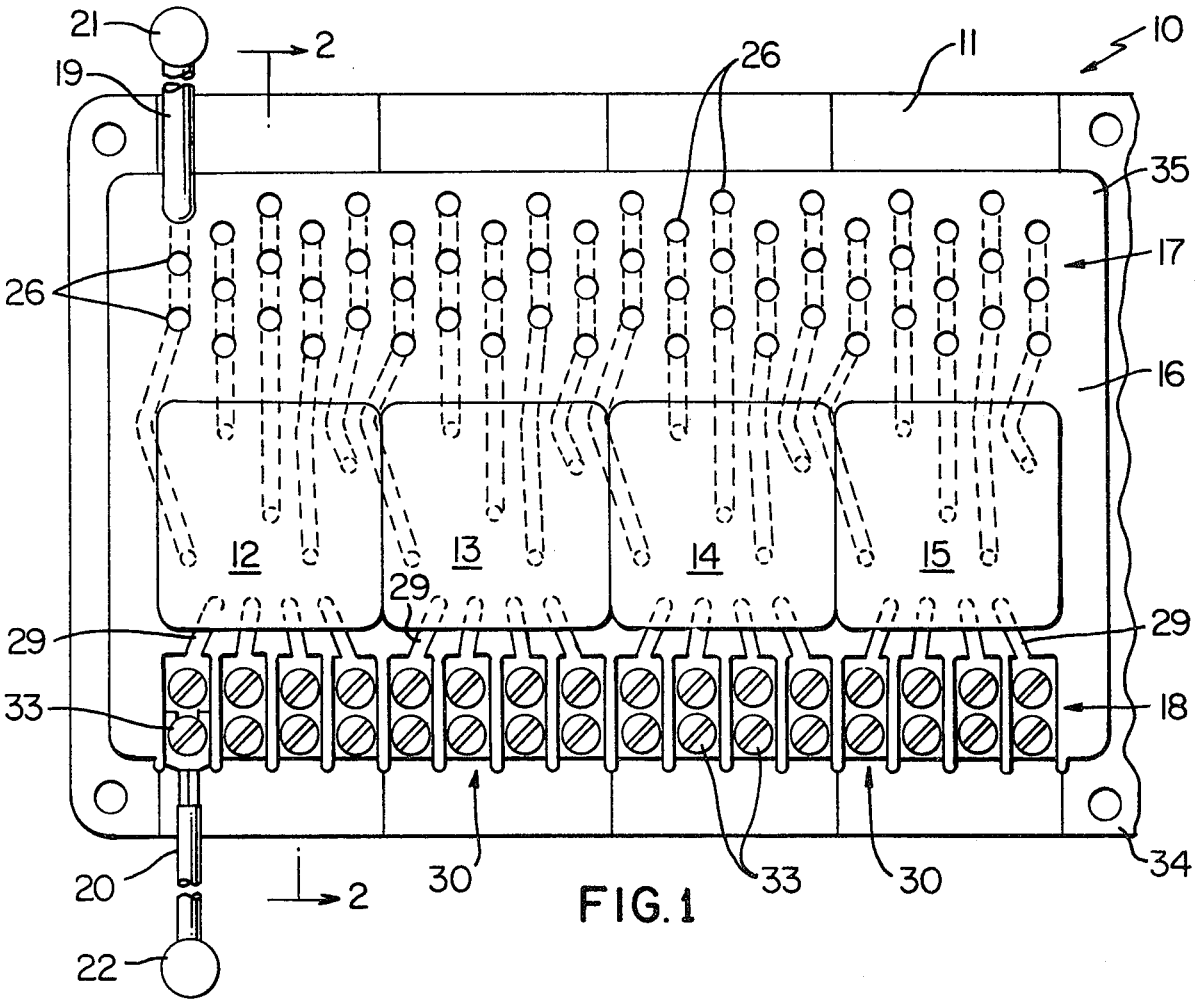
FIG. 1 is a top view of the improved manifold system of this invention.

While the various features of this invention are hereinafter described and illustrated as being particularly adapted to provide a manifold means for pneumatically and electrically operated control units, it is to be understood that the various features of this invention can be utilized singly or in any combination thereof to provide manifold means for other types of units as desired, such as control units that are only pneumatically operated or just electrically operated or a combination thereof.

Therefore, this invention is not to be limited to only the embodiments illustrated in the drawings, because the drawings are merely utilized to illustrate one of the wide variety of uses of this invention.

Figure 2:
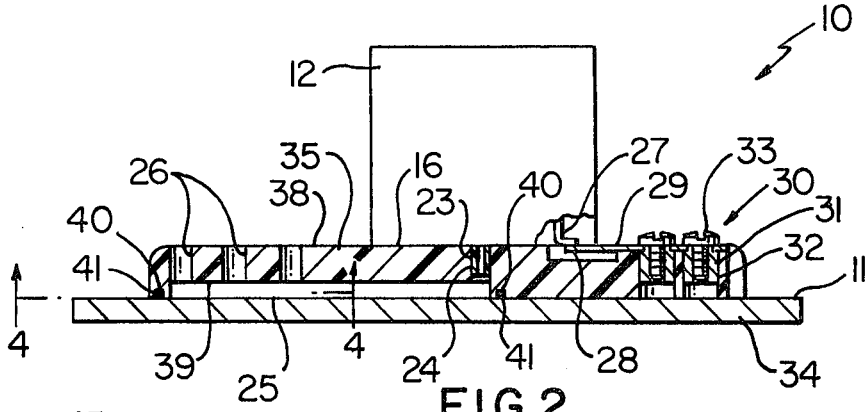
FIG. 2 is a cross-sectional view taken on line 2—2 of FIG. 1.

Referring now to FIGS. 1 and 2, the improved manifolding system of this invention is generally indicated by the reference numeral 10 and comprises a manifold means 11 detachably carrying a plurality of pneumatically and electrically operated control units 12, 13, 14 and 15 on one side 16 thereof that also has an upper row of external interconnection means generally indicated by the reference numeral 17 and a lower row of external interconnection means generally indicated by the reference numeral 18 for respectively being interconnected to external pneumatic lines 19 and external electrical lines 20 for respectively supplying fluid and electrical current from suitably sources 21 and 22 external to the manifold system 10 to operate the control devices 12–15 in a manner well known in the art for any desired purpose, such as for controlling the heating and cooling systems for a large building and the like.

The manifolding system 10 can be mounted in a control room in any conventional manner, such as by being placed and secured inside a control cabinet or the like.

Each control unit 12–15 can be provided with one or more plug-in nipples 23, FIG. 2, which are adapted to be received in plug-in recess means 24 formed in the side 16 of the manifold means 11, each recess means 24 interconnecting with an internal passage 25 of the manifold means 11 that defines part of the pneumatic means thereof.

Each passage 25 interconnects with the external interconnection means 17 which comprises a plurality of recesses 26 formed in the side 16 of the manifold means 11, three such recesses 26 being provided for each passage 25 and being disposed in spaced aligned relation. The three recess means 26 for each passage 25 are disposed in spaced parallel relation with the recesses 26 of the other passages 25 as illustrated in FIG. 1.

Thus, the passages 25 provide a pneumatic means of the manifold means 11 for supplying fluid to and from the external lines 19 between the recesses 26 and the recess means 24 leading to the output or input nipple means 23 of the control devices 12–15.

Similarly, the control devices 12–15 have one or more electrical contact members 27, FIG. 2, adapted to engage against the free end 28 of a conductive leaf member 29 forming part of a terminal means 30, the terminal means 30 defining the external interconnection means 18 for the manifold means 11.

Each conductive leaf 28 of each terminal means 30 is fastened to the manifold means 11 by a pair of conductive grommet means 31 each being received in an opening means 32 in the side 16 of the manifold means 11, each grommet 31 carrying a threaded fastening member 33 which is adapted to fasten an external electrical line 20 to the leaf member 29 whereby two such external lines 20 can be fastened to each terminal 30 if desired.

In this manner, electrical current from the source 22 can be interconnected by the external lines 20 and the electrical means 29 of the manifold means 11 to the conductive members 27 of the control devices 12–15 to operate the same in a manner well known in the art.

Thus, it can be seen that providing a plurality of plug-in recess means 24 in side 16 of the manifold means 11 in the manner illustrated in FIGS. 1 and 2, a desired number of control devices 12–15 can be plugged into the manifold means 11 on the side 16 thereof to have the pneumatically and electrically operated structure of the control units 12–15 be readily interconnected to the pneumatic means 25 and electrical means 29 of the manifold means 11 which in turn have the external interconnection means 17 and 18 thereof interconnected to external pneumatic lines 19 and electrical lines 20 on the same side 16 of the manifold means 11 whereby it is relatively easy to install the manifold means 11 in a cabinet or the like during the initial installation thereof as well as to subsequently interconnect the desired number of external lines 19 and 20 to the desired external interconnection means 26 and 30 for the devices 12–15 to function in a conventional manner, such features of the manifold means 11, manifold system 10 and method previously described being the same as in the aforementioned co-pending patent application.

However, the manifold means 11 of this invention is formed in a unique manner rather than being formed of a one-piece member as in the aforementioned co-pending patent application.

Figure 3:
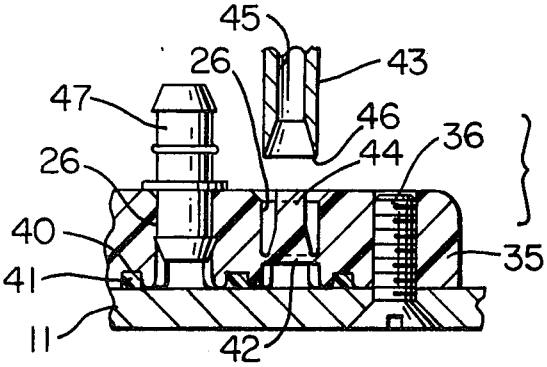
FIG. 3 is an enlarged fragmentary cross-sectional view of part of the manifold means of FIG. 1 and illustrates the method of forming the external pneumatic interconnection means thereof.

In particular, the manifold means 11 illustrated in FIGS. 1 and 2 comprises a substantially flat base plate 34 formed of metal, plastic or any other suitable material and being secured to an upper plate 35 by a plurality of threaded fastening members 36 in the manner illustrated in FIG. 3 so that the plates 34 and 35 are arranged in stacked relation with a lower surface 37 of the upper plate 35 bearing against the upper surface 38 of the lower plate 34, the upper plate 35 being formed of electrically insulating material, such as a plastic material or the like.

Figure 4:
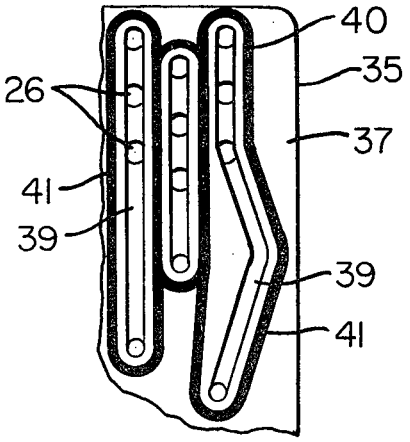
FIG. 4 is a fragmentary cross-sectional view taken on line 4—4 of FIG. 2.

The lower surface 37 of the upper plate 35 is provided with a plurality of grooves 39 in the desired pattern substantially as illustrated in FIG. 4 to be closed by the upper surface 38 of the lower plate 35 and thereby define the fluid passages 25 in the manifold means 11 for the purpose as previously described.

In order to seal closed the passages 25 from each other, the lower surface 37 of the plate 35 is provided with smaller grooves 40 completely surrounding each larger groove 39 so that the grooves 40 can receive annular resilient gasket means 41 as illustrated in FIGS. 2, 3 and 4 to provide sealing means against the upper surface 38 of the lower plate 34 when the plates 34 and 35 are secured together in stacked relation whereby all of the passages 25 are fluid sealed from each other.

Thus, it can be seen that the manifold means 11 of the manifold system of this invention can be formed in a relatively simple manner by merely making the plate 35 with the grooves 39 and 40 as well as the recesses 26, 24 and 32 so that the terminal means 30 can be added thereto and then the plates 35 can be secured to plate 34 by the threaded fastening means 36 in a simple and effective manner to provide the pneumatic passages 25 therebetween. Of course, the conductive leaves 29 and grommets 31 can be added before or after the plate 35 is secured to the plate 34 as desired.

If desired, the recesses 26 in the plate 35 could each be initially formed in the manner illustrated in FIG. 3 wherein an integral web section 42 of the plate 35 still spans and closes each recess 26 until a special cutting tool 43 or the like is inserted into the recess 26 to cut and core away the central web material 44 to completely open the passage 26 to the passage 25 as illustrated in FIG. 2. The tool 43 has an opening 45 passing therethrough which will press fittingly receive the central web material 44 of the respective recess 26 to carry away the core material 44 when the same is cut from the plate 35 by the lower cutting surface 46 of the tool 43.

In this manner, a recess 26 that has been opened by the tool 43 can have a nipple connector 47 inserted therein so as to provide means for fluidly interconnecting to a flexible conduit means 19 that have its end slipped over the plug connector 47 in a manner well known in the art.

Thus, the plate 35 will only have the desired recesses 26 thereof opened by the tool 43 and the other recesses 26 which are not opened by the tool 43 will remain closed by the core material 44 thereof and need not be further plugged as in the recess means of the aforementioned copending patent application.

Thus, it can be seen that the manifold means 11 of this invention is formed of two plates 34 and 35 by the method of this invention with the plate 35 being the part of the manifold 11 that not only carries the external interconnection means 17 and 18 for the pneumatic means 25 and electrical means 29 of the manifold means 11, but also the plate 35 is that part of the manifold means 11 that detachably carries the control units 12–15 thereon.

Another embodiment of the manifold means of this invention is indicated by the reference numeral 48 in FIGS. 5 and 6 and forms part of another manifolding system of this invention that is generally indicated by the reference numeral 49 in FIGS. 5 and 6, the manifold means 48 detachably carrying a plurality of control devices 50 and 51 in a manner hereinafter described.

The manifold means 48 comprises a lower substantially flat plate 52 formed of metal or any other suitable material having opposed ends 53 and 54 respectively being secured in any suitable manner to upper end plates 55 and 56 formed of electrically insulating plastic material or the like, the end plate 55 having a row of external interconnection means generally indicated by the reference numeral 57 and the end plate 56 having a row of external interconnection means generally indicated by the reference numeral 58.

The external interconnection means 57 of the end plate 55 are adapted to be interconnected to suitable external pneumatic lines 59' while the external interconnection means 58 of the end plate 56 are adapted to be interconnected to external electrical lines 60' so that fluid from a suitable source 61' and electrical current from a suitable source 62' can be directed by the external lines 59' and 60' to the control units 50 and 51 through the interconnection means 57 and 58 in a manner hereinafter described to operate the control units 50 and 51 in a conventional manner.

Figure 6:
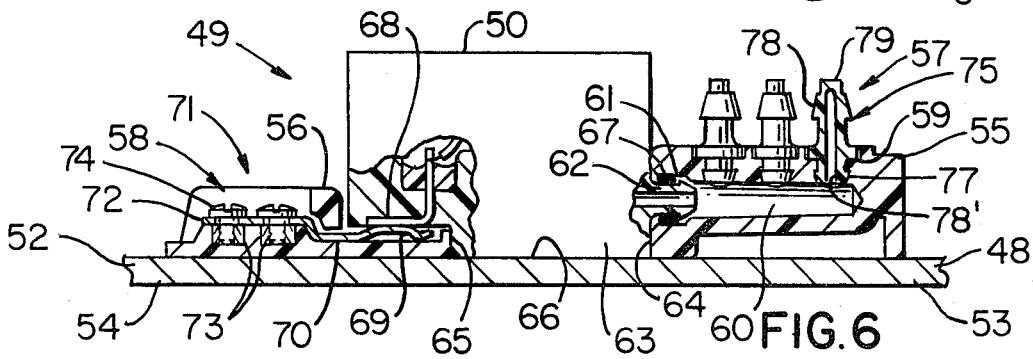
FIG. 6 is a cross-sectional view taken on line 6—6 of FIG. 5.

The external interconnection means 57 of the end plate 55 comprises a plurality of recesses 59 formed in a pattern similar to the recesses 26 previously described and leading to a plurality of internal passages 60 formed in the end plate 55 as illustrated in FIG. 6, three such recesses 59 being provided for each passage 60.

Each passage 60 of the end plate 55 has a plug-in recess means 61 interconnected thereto with the plug-in recess 59 being disposed substantially transverse to the facing direction of the major area of the side 62 of the manifold means 48 that receives the control units 50 and 51 in a manner hereinafter described.

In this manner, outwardly extending side plug-in nipple means 62 of the control unit 50 or 51 can be plugged into the transverse plug-in recesses 61 as illustrated in FIG. 6 with the lower part 63 of the control unit 50 or 51 being snap fitted between facing end surfaces 64 and 65 of the end plates 55 and 56 to firmly hold the plug-in control units 50 and 51 against the central portion 66 of the lower plate 53 as illustrated.

If desired, suitable resilient O-ring sealing means 67 can be carried by the plug-in nipple means 62 of the control units 50 and 51 to insure fluid sealing thereof in the plug-in recesses 61 in the end plate means 55.

Each control unit 50 or 51 can also include one or more conductive member 68 that is adapted to bear against the free resilient end 69 of a conductive leaf 70 for each terminal 71 that defines the external interconnection means 58 of the end plate 56 in a manner similar to the terminal 30 previously described. In particular, each leaf 70 has the end 72 thereof fastened to the end plate 56 by a pair of conductive grommets 73 each carrying a threaded fastening member 74 for securing one or two external electrical lines 60' thereto to be interconnected to the conductive leaf 70 and, thus, to the conductive member 68 of the control unit 50 or 51 as the case may be.

Figure 7:
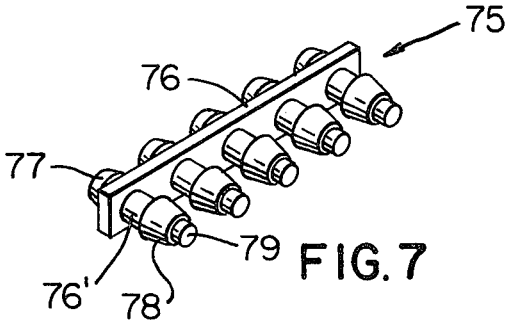
FIG. 7 is a perspective view of a conduit plug means for the interconnection means of the manifold means of the manifold system of FIGS. 5 and 6.
Figure 5:
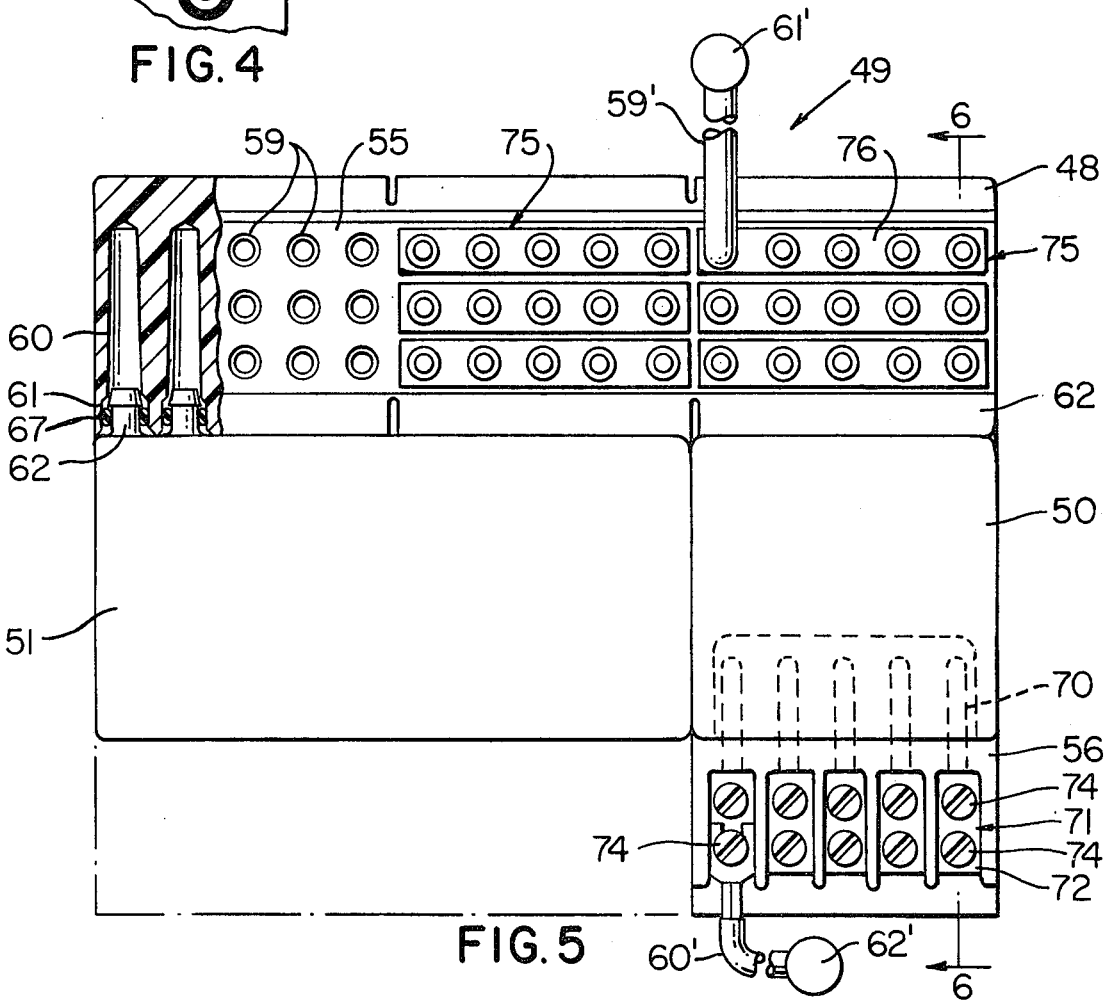
FIG. 5 is a view similar to FIG. 1 and illustrates another embodiment of the improved manifold system of this invention.

If desired, a plug strip that is generally indicated by the reference numeral 75 in FIG. 7 can be utilized for closing off all of the recesses 59 in a section of a particular row of five passages 60 for the control unit 50 as illustrated in FIGS. 5 and 6, the closing plug strip 75 including a central web 76 carrying a plurality of conduit plugs 76' having the lower ends 77 adapted to be received in the recesses 59 and the upper ends 78 adapted to be telescoped into flexible pneumatic conduit lines 59' in a manner well known in the art. The lower ends 77 of the plugs 76' are interrupted by openings 78', FIG. 6, that extend into the upper ends 78 which are closed by integral end caps 79 of the plugs 76'. Thus, the end cap 79 of a particular plug 76' must be cut off in order to permit a flexible conduit to be fluidly interconnected thereto. In this manner, by using the plug strips 75 to completely close all the recesses 59 in the end plate 55 of the manifold means 48, all the recesses 59 will be initially closed and then the conduits 59' can be interconnected to the plugs 76' where desired by merely cutting off the end caps 79 of the desired end plugs 76'.

Therefore, it can be seen that it is relatively a simple matter to plug-in or unplug the desired number of control units 50 and 51 to or from the manifold means 48 of this invention to form the manifold system 49 of this invention as each control unit 50 or 51 can have the side plug-in nipples 62 thereof readily inserted into the transverse plug-in recesses 61 of the end plate 55 whereby the particular control unit 50 or 51 will be fluidly interconnected to the pneumatic means 60 of the manifold means 48 as well as to the electrical means 70 thereof. At the same time the particular control unit 50 or 51 will be disposed on the same side 62 of the manifold means 48 that the external interconnection means 57 and 58 are provided on the manifold means 48 for interconnecting the external pneumatic lines 59' and electrical lines 60' thereof for accomplishing the inventive features of the aforementioned copending patent application.

Further, it can be seen that it is a readily simple matter to make the manifold means 48 of this invention by first forming the end plate means 55 and 56 and thereafter fastening the same to the end portions 53 and 54 of the lower plate 53 in a manner to provide for receiving the control units 50 and 51 in the central portion 66 of the manifold plate 53 in the manner previously described.

Accordingly, it can be seen that this invention not only provides improved manifold systems and manifold means therefor, but also this invention provides improved methods for making such manifold means.

While the forms and methods of this invention now preferred have been illustrated and described as required by the Patent Statute, it is to be understood that other forms and method steps can be utilized and still fall within the scope of the appended claims.

What is claimed is:

1. In a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement wherein said manifold means comprises a pair of plates secured together in stacked relation with one of said plates defining at least that part of said one side of said manifold means that carries said external interconnection means and is adapted to detachably carry said control units.

2. A manifold means as set forth in claim 1 wherein said plates cooperate together to define said pneumatic means therebetween.

3. A manifold means as set forth in claim 3 wherein one of said plates has a surface interrupted by a plurality of grooves, the other of said plates having a surface covering said grooves so that said grooves define passages in said manifold means that forms part of said pneumatic means thereof.

4. A manifold means as set forth in claim 3 wherein gasket means are disposed between said surfaces of said plates to seal said passages from each other.

5. A manifold means as set forth in claim 3 wherein said one plate has a surface opposed to said surface thereof that has said grooves therein, said other surface of said one plate being interrupted by a plurality of recesses that respectively intersect with said grooves thereof whereby said recesses define said external interconnection means for said pneumatic means of said manifold means.

6. In a method of making a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement comprising the steps of forming said manifold means from a pair of plates, and securing said plates together in stacked relation with one of said plates defining at least that part of said one side of said manifold means that carries said external interconnection means and is adapted to detachably carry said control units.

7. A method of making a manifold means as set forth in claim 6 and including the step of forming said plates so as to cooperate together to define said pneumatic means therebetween.

8. A method of making a manifold means as set forth in claim 7 and including the steps of forming a plurality of grooves on a surface of one of said plates, and covering said grooves with a surface of the other of said plates so that said grooves define passages in said manifold means that forms part of said pneumatic means thereof.

9. A method of making a manifold means as set forth in claim 7 and including the step of disposing gasket means between said surface of said plates to seal said passages from each other.

10. A method of making a manifold means as set forth in claim 7 and including the step of forming the surface of said one plate that is opposed to said surface thereof that has said grooves therein with a plurality of recesses that respectively intersect with said grooves thereof whereby said recesses define said external interconnection means for said pneumatic means of said manifold means.

11. In a combination of a manifold means detachably carrying on one side thereof a plurality of pneumatically and electrically operated control units each of which is fluidly and electrically interconnected to pneumatic means and electrical means of said manifold means that respectively have external interconnection means on said one side of said manifold means so that external pneumatic and electrical lines can be interconnected to the same side of said manifold means that said units are interconnected thereto, the improvement wherein said manifold means comprise a pair of plates secured together in stacked relation with one of said plates defining at least that part of said one side of said manifold means that carries said external interconnection means and is detachably carrying said control units.

12. A combination as set forth in claim 11 wherein said plates cooperate together to define said pneumatic means therebetween.

13. A combination as set forth in claim 13 wherein one of said plates has a surface interrupted by a plurality of grooves, the other of said plates having a surface covering said grooves so that said grooves define passages in said manifold means that forms part of said pneumatic means thereof.

14. A combination as set forth in claim 13 wherein gasket means are disposed between said surfaces of said plates to seal said passages from each other.

15. A combination as set forth in claim 13 wherein said one plate has a surface opposed to said surface thereof that has said grooves therein, said other surface of said one plate being interrupted by a plurality of recesses that respectively intersect with said grooves thereof whereby said recesses define said external interconnection means for said pneumatic means of said manifold means.

16. In a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement wherein said one side of said manifold means has plug-in recess means disposed therein substantially transverse to the major area of said one side and being adapted to receive plug-in nipples of said control units to detachably mount said control units to said one side of said manifold means.

17. A manifold means as set forth in claim 16 wherein said manifold means comprises a base plate means having opposed ends and a pair of end plate means respectively secured to said opposed end of said base plate means, one of said end plate means carrying said external interconnection means for said pneumatic means and the other of said end plate means carrying said external interconnection means for said electrical means.

18. A manifold means as set forth in claim 17 wherein said end plate means that carries said external interconnection means for said pneumatic means has said plug-in recess means therein.

19. A manifold means as set forth in claim 18 wherein said end plate means are spaced from each other to define a center portion on said base plate means adapted to receive said control units thereagainst.

20. A manifold means as set forth in claim 18 wherein said one end plate means that has said plug-in recess means therein has internal passages therein respectively interconnected to said recess means, said external interconnection means for said pneumatic means comprising a plurality of recesses in said one end plate means respectively interconnected with said passages whereby said passages defining said pneumatic means of said manifold means.

21. In a method of making a manifold means adapted to detachably carry on one side thereof a plurality of pneumatically and electrically operated control units each of which is adapted to be fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement comprising the step forming plug-in recess means in said one side of said manifold means substantially transverse to the major area of said one side so as to be adapted to receive plug-in nipples of said control units to detachably mount said control units to said one side of said manifold means.

22. A method of making a manifold means as set forth in claim 21 and including the steps of forming said manifold means from a base plate means having opposed ends, securing a pair of end plate means respectively to said opposed ends of said base plate means, causing one of said end plate means to carry said external interconnection means for said pneumatic means, and causing the other of said end plate means to carry said external interconnection means for said electrical means.

23. A method of making a manifold means as set forth in claim 22 and including the step of forming plug-in recess means in said end plate means that carries said external interconnection means for said pneumatic means.

24. A method of making a manifold means as set forth in claim 23 and including the step of forming said end plate means so as to be spaced from each other to define a center portion on said base plate means adapted to receive said control units thereagainst.

25. A method of making a manifold means as set forth in claim 23 and including the step of forming internal passages in said one end plate means that has said plug-in recess means therein so as to be respectively interconnected to said recess means, and forming said external interconnection means for said pneumatic means as a plurality of recesses in said one end plate means respectively interconnected with said passage whereby said passages define said pneumatic means of said manifold means.

26. In a combination of a manifold means detachably carrying on one side thereof a plurality of pneumatically and electrically operated control units each of which is fluidly and electrically interconnected to pneumatic means and electrical means of said manifold means that respectively have external interconnection means on said one side of said manifold means so that external pneumatic and electrical lines can be interconnected to the same side of said manifold means that said units are adapted to be interconnected thereto, the improvement wherein said one side of said manifold means has plug-in recess means disposed therein substantially transverse to the major area of said one side and receiving plug-in nipples of said control units to detachably mount said control units to said one side of said manifold means.

27. A combination as set forth in claim 26 wherein said manifold means comprises a base plate means having opposed ends and a pair of end plate means respectively secured to said opposed ends of said base plate means, one of said end plate means carrying said external interconnection means for said pneumatic means and the other of said end plate means carrying said external interconnection means for said electrical means.

28. A combination as set forth in claim 27 wherein said end plate means that carries said external interconnection means for said pneumatic means has said plug-in recess means therein.

29. A combination as set forth in claim 28 wherein said end plate means are spaced from each other to define a center portion on said base plate means receiving said control units thereagainst.

30. A conbination as set forth in claim 28 wherein said one end plate means that have said plug-in recess means therein has internal passages therein respectively interconnected to said recess means, said external interconnection means for said pneumatic means comprising a plurality of recesses in said one end plate means respectively interconnected with said passages whereby said passages define said pneumatic means of said manifold means.

* * * * *